US005357225A

United States Patent [19]

Mortensen

[11] Patent Number: 5,357,225

[45] Date of Patent: Oct. 18, 1994

[54] METHOD AND APPARATUS FOR ADJUSTING THE IMPEDANCE OF A MICROSTRIP TRANSMISSION LINE

[75] Inventor: Duane L. Mortensen, Lucas, Tex.

[73] Assignee: Alcatel Network Systems, Inc., Richardson, Tex.

[21] Appl. No.: 996,099

[22] Filed: Dec. 23, 1992

[51] Int. Cl.[5] ..... H01P 1/18; H01P 1/00

[52] U.S. Cl. ..... 333/161; 333/246; 333/263; 361/301.1

[58] Field of Search ..... 333/161, 203–205, 333/238, 246, 263, 24 C; 361/301, 303, 326

[56] References Cited

U.S. PATENT DOCUMENTS

| | | | |
|---|---|---|---|
| 3,538,459 | 11/1970 | Knerr | 333/238 X |
| 4,388,599 | 6/1983 | Gautier et al. | 333/161 X |
| 4,721,931 | 1/1988 | Nishikawa et al. | 333/246 X |
| 5,105,173 | 4/1992 | Itou | 333/204 |

FOREIGN PATENT DOCUMENTS

| | | | |
|---|---|---|---|
| 276905 | 10/1992 | Japan | 333/238 |

*Primary Examiner*—Paul Gensler
*Attorney, Agent, or Firm*—Baker & Botts

[57] ABSTRACT

An interdigital capacitor (10) is provided including a plurality of conductive and dielectric finger regions. The conductive finger regions are made of the same material type as a microstrip transmission line (12). The conductive finger regions are comprised of individual conductive fingers (14) and the individual conductive fingers (14) provide a predetermined level of impedance to the microstrip transmission line. The plurality of conductive finger regions are comprised of a first finger region (18) and a second finger region (20). The first finger region (18) is coupled to the microstrip transmission line (12) and the second conductive finger region (20) is coupled to ground (22). The individual conductive fingers (14) of the first conductive region (18) are located parallel and interspersed with the individual conductive fingers (14) of the second conductive finger region (20). Because the individual fingers (14) of the conductive finger region provide a predetermined level of impedance to the interdigital capacitor (10), the value of the interdigital capacitor (10) can be adjusted by a known amount by removing one or more individual conductive fingers (18). This in turn provides a known response in the phase of a signal travelling on the microstrip transmission line (12).

7 Claims, 1 Drawing Sheet

METHOD AND APPARATUS FOR ADJUSTING THE IMPEDANCE OF A MICROSTRIP TRANSMISSION LINE

TECHNICAL FIELD OF THE INVENTION

This invention relates in general to the field of electronic devices, and more particularly to a method and apparatus for adjusting the impedance of a microstrip transmission line to change the phase of a radiofrequency (RF) signal on the microstrip transmission line. Even more specifically, the invention is related to a method and apparatus for phase tuning an RF signal using a microstrip transmission line with an adjustable impedance.

BACKGROUND OF THE INVENTION

Radiofrequency (RF) signals have use in household radios, radio telecommunication networks, microwave telecommunication networks, and many other systems. Radiofrequency signals are characterized by a frequency phase. Microstrip transmission lines carry radiofrequency signals between devices within a circuit. Manufacturing microstrip transmission lines usually includes forming a thin layer of conductive material, e.g., copper, on the top nonconductive dielectric surface of a circuit board. Microstrip transmission lines form the necessary connections between the components on an RF circuit board.

In certain applications, adjusting the phase or phase tuning an RF signal is necessary. Altering the impedance of the microstrip transmission line on which the signals are travelling is one method of phase tuning. For example, for a signal travelling at a 94 degree phase on a microstrip transmission line relative to a reference, by reducing the impedance of the microstrip transmission line the phase of the signal can be changed to 90 degrees relative to the reference.

The impedance of a microstrip transmission line results from the inductance and the capacitance of the material used to make the microstrip transmission line. The material, amount of material, and shape of the material used to form the microstrip transmission line affect the impedance of a microstrip transmission line. Different types of materials, for example, copper versus silver, have associated different impedance characteristics. Also, long, thin microstrip transmission lines have higher impedance, and inversely, short, wide microstrip transmission lines have lower impedance. The shape of the microstrip transmission line also adds to the impedance of the line. Straight microstrip transmission lines will, for example, have less impedance than spiral microstrip transmission lines.

Past approaches to alter the impedance of a microstrip transmission line include using RF variable capacitors, tuning chips, and capacitive stubs. Using RF variable capacitors requires attaching the capacitor to the microstrip transmission line. Signals are phase tuned by adjusting the value of the variable capacitor. The disadvantages of RF variable capacitors include their high cost, large size, and construction which is subject to mechanical failure and microphonics. Additionally, the packaging of RF variable capacitors provides a minimum capacitance which cannot be adjusted out, and also, affects the capacitance characteristic of the RF variable capacitor in applications above 2 gigahertz.

A second approach for altering the impedance of a microstrip transmission line is by attaching tuning capacitive chips of metal or dielectric to the microstrip transmission line with an adhesive. Using tuning capacitance chips has many disadvantages including the time and labor necessary to determine the proper size and location of the chip, and attaching the chip to the microstrip transmission line. Tuning chips can also fall off the circuit board if the adhesive fails.

A third approach for altering the impedance of a microstrip transmission line is using capacitive stubs connected to the microstrip transmission line. In this approach, a length and width of material of the same type as the microstrip transmission line are made a part of the microstrip transmission line. The capacitive stub provides impedance to the microstrip transmission line. Removing a portion of the length of the capacitive stub alters the impedance of the microstrip transmission line. The change in impedance thereby alters the phase of a radiofrequency signal travelling on the microstrip transmission line.

Using capacitive stubs is a very reiterative process. This process involves measuring the phase of the signal relative to a reference, removing portions of the capacitive stub and then remeasuring the phase of the signal. These steps are duplicated until the desired phase shift in the signal is achieved. If too much of the capacitive stub is removed during the phase tuning of the RF signal then the circuit board is ruined. Once portions of the capacitive stub are removed, the capacitive stub cannot be rebuilt. Since it is impossible to determine beforehand how much of the capacitive stub to remove in order to phase tune the RF signal, this process often results in unusable circuit boards.

Unfortunately, this result is exasperated because tuning the signal with a capacitive stub often occurs only after the circuit board has been populated with other devices. Therefore, if the signal cannot be adequately tuned by altering the capacitive stub, then the components on the circuit board have to be removed for placement on another circuit board. Removing the components from the circuit board often results in damage to these sometimes expensive parts, and leads to not only scrapping the original circuit board, but also all of the components that were previously placed on the circuit board.

It is an object of the present invention, therefore, to provide an improved method and apparatus for altering the impedance of a microstrip transmission line that overcomes the limitations of prior art capacitive devices. It is an object of the present invention to provide a interdigital capacitor that is connected to the microstrip transmission line. The technical advantage of the present invention is the interdigital capacitor is in a shape such that, by removing portions of the interdigital capacitor, a predetermined and known change to the capacitance of the interdigital capacitor and, therefore, the to impedance of the microstrip transmission line is achieved. This in turn provides a predetermined and known result in the phase of the RF signal travelling on the microstrip transmission line. It is a further object of the present invention to provide an apparatus and method using the interdigital capacitor coupled to the microstrip transmission line to phase tune a radiofrequency signal travelling on the microstrip transmission line. By measuring the phase of a signal relative to a reference and knowing the predetermined impact to the phase of the signal by removing a known quantity of impedance from the interdigital capacitor coupled to the microstrip transmission line, the phase of the signal can be altered without the reiterative processes or limitations of the prior art.

BRIEF DESCRIPTION OF THE DRAWINGS

Other objects and advantages of the present invention will be apparent from the reading of the specification and appended claims in conjunction with drawings, wherein:

DETAILED DESCRIPTION OF THE INVENTION

Figure 1:
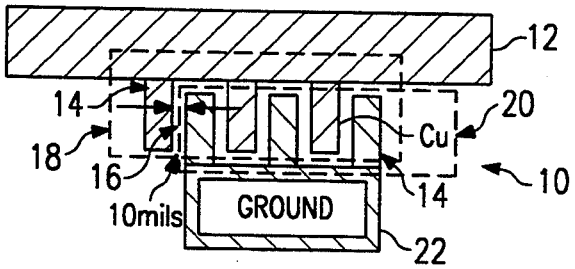
FIG. 1 provides a simplified view of the preferred embodiment of the present invention.

In FIG. 1 is shown a simplified view of the preferred embodiment of interdigital capacitor 10 connected to microstrip transmission line 12. Interdigital capacitor 10 includes individual conductive fingers 14 and associated dielectric regions 16. Individual conductive fingers 14 are grouped into first conductive finger region 18 that connects to microstrip transmission line 12 and second conductive finger region 20 that connects to ground 22. First conductive finger region 18 and second conductive finger region 20 include individual fingers 14 that provide a predetermined level of capacitance to interdigital capacitor 10 and transmission line 12. Second conductive finger region 20 may be capacitively coupled to ground 22.

Individual conductive fingers 14 of first conductive finger region 18 are parallel and interspersed with individual conductive fingers 14 of second conductive finger region 20. Individual conductive fingers 14 and associated dielectric regions 16 form the capacitance within the interdigital capacitor 10. Typical dimensions of the elements in FIG. 1 include the width of the individual fingers 14 which approximates 10 mils. The spacing between the individual conductive fingers 14, that is, associated dielectric region 16, also measures approximately 10 mils. Microstrip transmission line 12 may be gold, copper, silver, aluminum or any other suitable conductive material. Individual conductive fingers 14 are made of the same material as microstrip transmission line 12. Associated dielectric regions 16 use any suitable dielectric material. For example, that material sold under the trade name of Duroid from Rogers Corporation has been successfully used to form associated dielectric regions 16.

With the dimensions of individual conductive fingers 14 and associated dielectric regions 16 at 10 mils, each individual conductive finger 14 of interdigital capacitor 10 provides 0.2 picofarads of capacitance. In the preferred embodiment, the 0.2 picofarads capacitance per conductive finger 14 translates to approximately 1.5 degrees of phase shift to an RF signal on microstrip transmission line 12 for each individual conductive finger 14 removed from the interdigital capacitor 10. Halving the width of the associated conductive finger regions 18 and 20 and associated dielectric regions 16 to 5 mils results in approximately twice the capacitance in interdigital capacitor 10. The number of individual conductive fingers 14 in interdigital capacitor 10 effectively controls the phase tuning capability of the interdigital capacitor 10. As the number of individual conductive fingers 14 increases, however, more of the signal goes to ground. This leaves less usable signal in the circuit.

Because the size of individual conductive fingers 14 is relatively large (e.g. 10 mils), individual conductive fingers 14 may be removed without special precision equipment. This makes adjusting the impedance of microstrip transmission line 12 and, therefore, the phase of the RF signal traveling on the microstrip transmission line 12 much easier.

Variations on the capacitance adjustments that the preferred embodiment provides are numerous. For example, in an embodiment where second conductive finger region 20 capacitively couples to ground 22, removing an individual finger 14 from second conductive finger region 20 provides a larger capacitance change in interdigital capacitor 10 than does removing an individual finger 14 from first conductive finger region 18. This is due to the added capacitance in capacitively coupling second conductive finger region 20 to ground 22. Furthermore, half of an individual conductive finger 14 could be removed, as well as multiple or all individual conductive fingers from interdigital capacitor 10 to accomplish the phase tuning aspects of the preferred embodiment.

Figure 2:
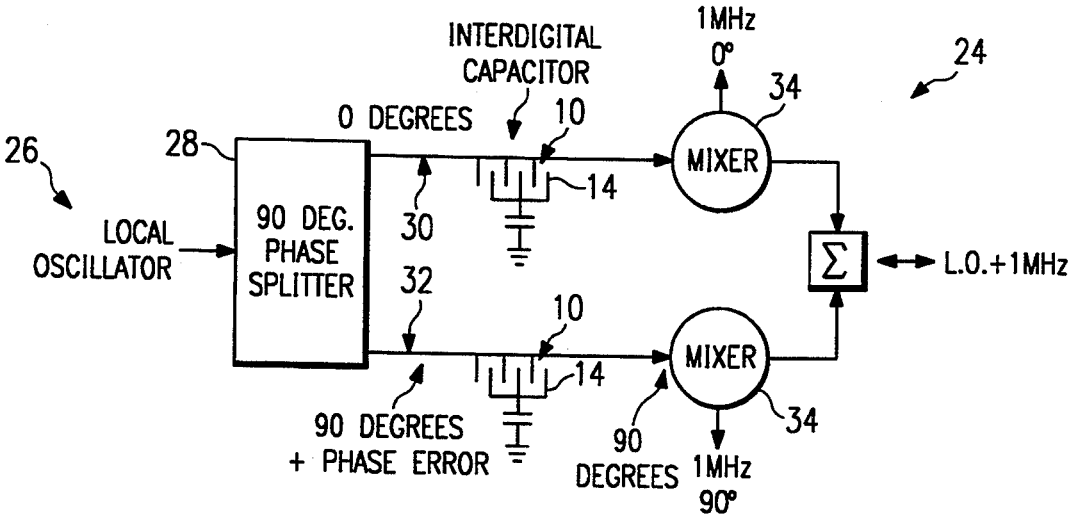
FIG. 2 depicts a circuit application of the preferred embodiment.

In FIG. 2, an embodiment of the present invention in association with mixer circuit 24 appears. Mixer circuit 24 may be used, for example, in a modulator of demodulator in a radio. The circuit includes local oscillator 26 that connects to 90-degree phase splitter 28. The 90-degree phase splitter 28 connects by upper microstrip transmission line 30 and lower microstrip transmission line 32 to two mixers each designated by reference numeral 34. The upper microstrip transmission line 30 and lower microstrip transmission line 32 also connect to interdigital capacitors 10 of the preferred embodiment.

In the operation of the mixer circuit 24 in FIG. 2, local oscillator 26 generates a RF signal that enters phase splitter 28. Phase splitter 28 splits the signal into two separate signals both at the same frequency, but at a 90-degree phase difference. The first or reference signal is on upper microstrip transmission line 30, and the second signal is on lower microstrip transmission line 32. The 90-degree phase difference between the two signals coming out of phase splitter 28 is subject to a phase error. Therefore, for example, the phase difference may be 92, 94 or even 88 degrees. The phase error is a function of the precision of 90-degree phase splitter 28. In a modulator application, the signals must be at exactly a predetermined phase difference with minimal phase error (e.g., $\pm 2$ degrees). In the embodiment in FIG. 2, the difference must be 90 degrees in order for mixer circuit 24 to operate properly. Therefore, the phase difference of the two signals travelling on microstrip transmission lines 30 and 32 must be exactly 90 degrees when they enter the two mixers 34. If the phase differs by greater than the allowable error at mixers 34 then mixer circuit 24 does not operate properly.

The present invention effectively eliminates the phase errors or phase differences of the two signals in the circuit of FIG. 2. A vector volt meter may be used to effectively measure the phase difference between the two signals travelling on upper microstrip transmission line 30 and lower microstrip transmission line 32. Once the phase difference is measured, the capacitance of interdigital capacitor 10 may be altered by removing individual conductive fingers 14. This changes the phase of the signal travelling on the microstrip transmission line.

For example, if each individual conductive finger 14 changes the phase of the signal by 1.5 degrees and the phase difference measures 94.5 degrees, then removing three individual conductive fingers 14 from the interdigital capacitor 10 on the lower microstrip transmission line 32 causes the phase of the signal travelling on the lower microstrip transmission line 32 to shift by the necessary 4.5 degrees (i.e., 1.5 degrees per finger times three fingers). This results in the required 90-degree phase difference between the signals on microstrip transmission lines 30 and 32. Similarly, suppose if the phase difference between the signals on upper microstrip transmission line 30 and lower microstrip transmission line 32 is less than 90 degrees (e.g. 85.5 degrees). Removing three individual conductive fingers 14 from interdigital capacitor 10 that connects to upper microstrip transmission line 30 shifts the phase of the signal on line 30 by the necessary 4.5 degrees. This, again, results in a 90 degree phase difference between the two signals.

Figure 3:
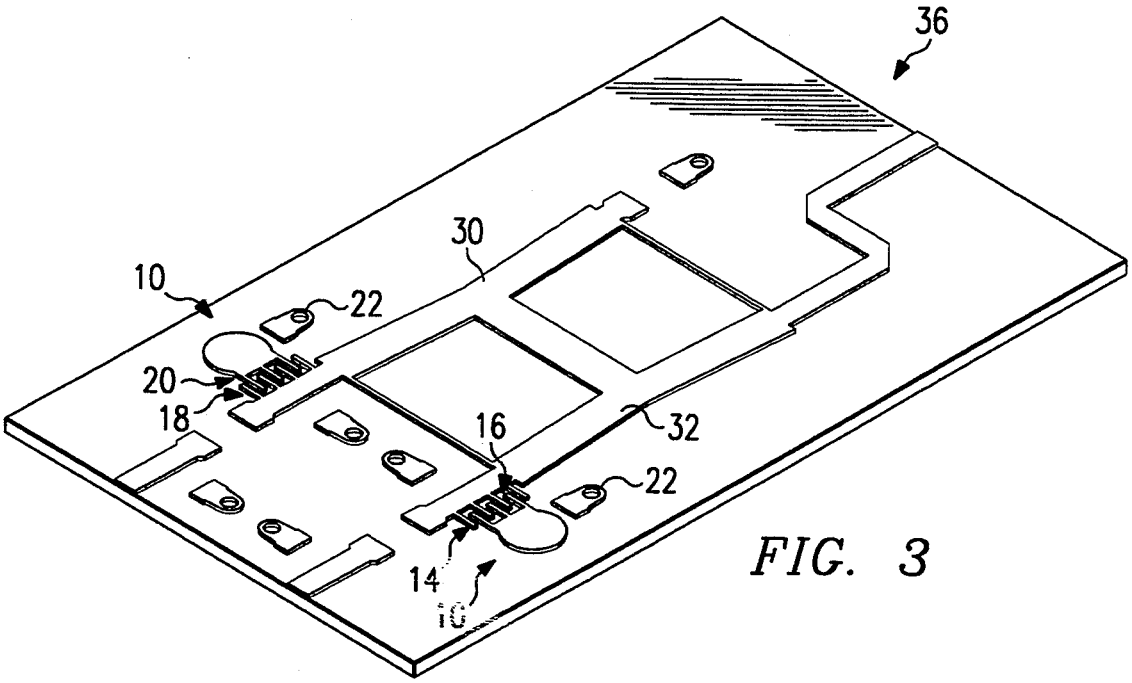
FIG. 3 depicts a perspective view of a circuit implementation of the preferred embodiment.

FIG. 3 shows an isometric view of one embodiment of the present invention as implemented in circuit board 36. A typical thickness for the microstrip transmission line 12 and interdigital capacitor 10 above the dielectric surface 16 is approximately 1 mil. On circuit board 36, radiofrequency signals travel on upper microstrip transmission line 30 and lower microstrip transmission line 32. Interdigital capacitors 10 connect to microstrip transmission lines 30 and 32 and provide capacitive impedance to signals that lines 30 and 32 carry. Removing one or more individual conductive fingers 14 from either interdigital capacitor 10 of circuit board 36 alters the impedance of the combined interdigital capacitor 10 and microstrip transmission lines 30 and 32 by a predetermined amount. The removal of this predetermined amount of impedance has a corresponding predetermined change to the phase of the radiofrequency signals travelling on the microstrip transmission lines 30 and 32. As described above, the selection of which individual conductive fingers 14 to remove depends on whether the phase difference is greater than or less than the design difference.

The embodiment shown in FIG. 3 of the present invention demonstrates some of its technical advantages. Because interdigital capacitors 10 are of the same material type as microstrip transmission line 12, interdigital capacitors 10 may be formed with the same process used to form microstrip transmission line 12. No separate parts must be handled and assembled in this embodiment of the present invention. This minimizes assembly costs and reduces the opportunities for defect causing abnormalities. Also, in the embodiment of the present invention shown in FIG. 3, it is possible to remove all of interdigital capacitor 10 by removing all of the individual conductive fingers 14. This provides zero capacitive load to the microstrip transmission line 12. As discussed above, a zero capacitance load with some of the prior art solutions is not possible. The preferred embodiment also simplifies adjusting the phase of an RF signal to the point where a technician at manufacturing can quickly determine how many fingers to remove in tuning the circuit of circuit board 36.

Other embodiments of the present invention can easily be identified, but that have not been discussed in detail herein include, for example, the output stage of a power amplifier that uses two parallel running signals that need to be at a specified phase difference before they are combined; as well as the application of adjusting the phase relationship of a source signal to a known oscillator signal.

OPERATION

The basic operation of the preferred embodiment 10 is very straightforward once conceived and comprises, for example, connecting interdigital capacitor 10 to a microstrip transmission line 12. In the preferred embodiment, the impedance of microstrip transmission line 12 is altered by removing individual conductive fingers 14 from interdigital capacitor 10. Because individual conductive fingers 14 provide a predetermined level of capacitance to interdigital capacitors 10 and, therefore, to microstrip transmission line 12, removing them changes the impedance of the microstrip transmission line by a known amount and, thereby, shifts the phase of the signal on microstrip transmission line 12 by a known amount.

In summary, we have illustrated one embodiment of the inventive concept of an interdigital capacitor coupled to a microstrip transmission line. The interdigital capacitor includes a plurality of conductive and dielectric finger regions. The plurality of conductive finger regions are made of the same material type as a microstrip transmission line. The conductive finger regions are comprised of individual conductive fingers, and the individual conductive fingers provide a predetermined level of impedance to the microstrip transmission line. The plurality of conductive finger regions are comprised of a first finger region and a second finger region. The first finger region is coupled to the microstrip transmission line and the second conductive finger region is coupled to ground. The individual conductive fingers of the first conductive region are located parallel and interspersed with the individual conductive fingers of the second conductive finger region. Because the individual fingers of the conductive finger regions provide a predetermined level of capacitance to the interdigital capacitor, the value of the interdigital capacitor may be adjusted by a known amount by removing one or more fingers. This, in turn, provides a known response in the signal travelling on the microstrip transmission line to which the interdigital capacitor is connected.

As a result of the above, although the invention has been described with reference to the above embodiments, its description is not meant to be construed in a limiting sense. Various modifications of the disclosed preferred embodiment, as well as the alternative embodiments of the invention may make further embodiments apparent to a person skilled in the art upon reference to the above-description. It is, therefore, contemplated that the appended claims will cover such modifications that fall within the true scope of the invention.

What is claimed is:

1. A method for adjusting the impedance of a microstrip transmission line comprising the steps of:

coupling a first conductive finger region to the microstrip transmission line, the first conductive finger region including a plurality of removable individual conductive fingers providing a predetermined level of impedance to the microstrip transmission line;

coupling a second conductive finger region to ground, the second conductive finger region including a plurality of removable individual conductive fingers providing a predetermined level of impedance to the microstrip transmission line;

locating the first conductive finger region and the second conductive finger region so that the individual conductive fingers of the first conductive finger region are substantially perpendicular to the microstrip transmission line and parallel and interspersed with the individual conductive fingers of the second conductive finger region;

removing individual conductive fingers from the first conductive finger region to alter the impedance of the microstrip transmission line; and removing individual conductive fingers from the second conductive finger region to alter the impedance of the microstrip transmission line.

2. An interdigital capacitor for adjusting the impedance of a microstrip transmission line, the interdigital capacitor being coupled to the microstrip transmission line and to ground, the interdigital capacitor comprising:

a plurality of conductive finger and dielectric regions, said conductive finger regions being made of the same material type as the microstrip transmission line, said conductive finger regions including removable individual conductive fingers providing a predetermined level of impedance to the microstrip transmission line, said plurality of conductive finger regions including a first conductive finger region and a second conductive finger region, said first conductive finger region coupled to the microstrip transmission line and said second conductive finger region capacitively coupled to ground, said individual conductive fingers of said first conductive finger region located parallel and interspersed with said individual conductive fingers of said second conductive finger region, said plurality of dielectric regions being located between said individual conductive fingers.

3. A method for adjusting the impedance of a microstrip transmission line comprising the steps of:

coupling a first conductive finger region to the microstrip transmission line, the first conductive finger region including a plurality of removable individual conductive fingers providing a predetermined level of impedance to the microstrip transmission line;

capacitively coupling a second conductive finger region to ground, the second conductive finger region including a plurality of removable individual conductive fingers providing a predetermined level of impedance to the microstrip transmission line;

locating the first conductive finger region and the second conductive finger region so that the individual conductive fingers of the first conductive finger region are substantially perpendicular to the microstrip transmission line and parallel and interspersed with the individual conductive fingers of the second conductive finger region;

removing individual conductive fingers from the first conductive finger region to alter the impedance of the microstrip transmission line; and removing individual conductive fingers from the second conductive finger region to alter the impedance of the microstrip transmission line.

4. An apparatus for phase tuning radio frequency signals at the same frequency but at a predetermined phase shift subject to phase error, on a plurality of microstrip transmission lines, the plurality of microstrip transmission lines including a first and second microstrip transmission line with a single signal travelling on each microstrip transmission line, comprising:

an interdigital capacitor coupled to each microstrip transmission line, each said interdigital capacitor including a plurality of conductive finger regions and dielectric regions, said conductive finger regions being made of the same material type as the microstrip transmission line, said conductive finger regions including removable individual conductive fingers, said individual conductive fingers being separated by dielectric regions, said individual conductive fingers providing a predetermined level of impedance to the microstrip transmission line, said plurality of conductive finger regions including a first conductive finger region and a second conductive finger region, said first conductive finger region being coupled to the microstrip transmission line and said second conductive finger region being coupled to ground, said individual conductive fingers of said first conductive finger region being substantially perpendicular to the microstrip transmission line and located parallel and interspersed with said individual conductive fingers of said second conductive finger region, the phase error being removed by altering the impedance of the first microstrip transmission line by removing from said interdigital capacitor coupled to the first microstrip transmission line said individual conductive fingers of said first conductive finger region or said second conductive finger region, or the phase error is removed by removing from said interdigital capacitor coupled to the second microstrip transmission line said individual conductive fingers of said first conductive finger region or said second conductive finger region.

5. A method for adjusting the phase difference between radio frequency signals on microstrip transmission lines, the microstrip transmission lines including a first and second microstrip transmission line comprising the steps of:

coupling an interdigital capacitor to each microstrip transmission line;

forming each of the interdigital capacitors to include a plurality of conductive finger regions and a plurality of dielectric regions, the conductive finger regions being made of the same material type as the microstrip transmission lines;

forming the conductive finger regions to include removable individual conductive fingers, the individual conductive fingers providing a predetermined level of impedance to the microstrip transmission line, the plurality of conductive finger regions comprised of a first conductive finger region and a second conductive finger region, the first conductive finger region being coupled to the microstrip transmission line and the second conductive finger region being coupled to ground;

positioning the first conductive finger region coupled to the microstrip transmission line and the second conductive finger region coupled to ground so that the individual conductive fingers of the first conductive finger region are located parallel and interspersed with the individual conductive fingers of the second conductive finger region;

measuring the phase difference between radio frequency signals on the first and second microstrip transmission lines;

removing from the interdigital capacitor coupled to the first microstrip transmission line individual conductive fingers from said first conductive finger region or the second conductive finger region to change the impedance of the first microstrip transmission line by a predetermined amount for each individual finger removed, thereby altering the phase of the signal on the first microstrip transmission line and removing the phase error between the radio frequency signals; and removing from the interdigital capacitor coupled to the second microstrip transmission line individual conductive fingers from said first conductive finger region or said second conductive finger region to change the impedance of the second microstrip transmission line by a predetermined amount for each individual finger removed, thereby altering the phase of the signal on the second microstrip transmission line and removing the phase error between the radio frequency signals.

6. An apparatus for phase tuning radio frequency signals at the same frequency but at a predetermined phase shift subject to phase error on a plurality of microstrip transmission lines, the plurality of microstrip transmission line with a single signal travelling on each microstrip transmission line, comprising:

an interdigital capacitor coupled to each microstrip transmission line, each of said interdigital capacitors including a plurality of conductive finger regions and dielectric regions, said conductive finger regions being made of the same material type as the microstrip transmission lines, said conductive finger regions including removable individual conductive fingers, said individual conductive fingers being separated by dielectric regions, said individual conductive fingers providing a predetermined level of impedance to the microstrip transmission line, said plurality of conductive finger regions including a first conductive finger region and a second conductive finger region, said first conductive finger region being coupled to the microstrip transmission line and said second conductive finger region being capacitively coupled to ground, said individual conductive fingers of said first conductive finger region located parallel and interspersed with said individual conductive fingers of said second conductive finger region, the phase error removed by altering the impedance of the first microstrip transmission line by removing from said interdigital capacitor coupled to the first microstrip transmission line said individual conductive fingers of said first conductive finger region or said second conductive finger region, or the phase error is removed by removing from said interdigital capacitor coupled to the second microstrip transmission line said individual conductive fingers of said first conductive finger region or said second conductive finger region.

7. A method for adjusting the phase difference between radio frequency signals on microstrip transmission lines, the microstrip transmission lines including a first and second microstrip transmission line, the method comprising the steps of:

coupling an interdigital capacitor to each microstrip transmission line;

forming each of the interdigital capacitors to include a plurality of conductive finger regions and a plurality of dielectric regions, the conductive finger regions being made of the same material type as the microstrip transmission lines;

forming the conductive finger regions to include removable individual conductive fingers, the individual conductive fingers providing a predetermined level of impedance to the microstrip transmission line, the plurality of conductive finger regions including a first conductive finger region and a second conductive finger region, the first conductive finger region coupled to the microstrip transmission line and the second conductive finger region capacitively coupled to ground;

positioning the first conductive finger region coupled to the microstrip transmission line and the second conductive finger region being coupled to ground so that the individual conductive fingers of the first conductive finger region are located parallel and interspersed with the individual conductive fingers of the second conductive finger region;

measuring the phase difference between radio frequency signals on the first and second microstrip transmission lines;

removing from the interdigital capacitor coupled to the first microstrip transmission line individual conductive fingers from said first conductive finger region or said second conductive finger region to change the impedance of the first microstrip transmission line by a predetermined amount for each individual finger removed thereby altering the phase of the signal on the first microstrip transmission line and removing the phase error between the radio frequency signals; and removing from the interdigital capacitor coupled to the second microstrip transmission line individual conductive fingers from said first conductive finger region or said second conductive finger region to change the impedance of the second microstrip transmission line by a predetermined amount for each individual finger removed thereby altering the phase of the signal on the second microstrip transmission line and removing the phase error between the radio frequency signals.

* * * * *

UNITED STATES PATENT AND TRADEMARK OFFICE

CERTIFICATE OF CORRECTION

PATENT NO. : 5,357,225

DATED : Oct. 18, 1994

INVENTOR(S) : Mortensen

It is certified that error appears in the above-identified patent and that said Letters Patent is hereby corrected as shown below:

Column 2, line 56, delete "the to", and insert -- to the --.

Column 3, line 64, after "to 5 mils", insert -- , --.

Column 4, line 27, after "in a modulator", delete "of" and insert -- or --.

Column 4, line 49, after "28", insert --and the phase/delay characteristics of mixers 34--.

Column 9, line 27, after "microstrip" delete "lines", and insert --transmission lines including a first and second microstrip--.

Signed and Sealed this

Twenty-fourth Day of October, 1995

*Attest:*

Bruce Lehman

BRUCE LEHMAN

*Attesting Officer*

*Commissioner of Patents and Trademarks*